US007487749B2

(12) United States Patent
Sedda et al.

(10) Patent No.: US 7,487,749 B2
(45) Date of Patent: Feb. 10, 2009

(54) ELECTROMECHANICAL VALVE ACTUATOR FOR INTERNAL COMBUSTION ENGINES AND INTERNAL COMBUSTION ENGINE EQUIPPED WITH SUCH AN ACTUATOR

(75) Inventors: Emmanuel Sedda, Conflans Sainte Honorine (FR); Christophe Fageon, Montrouge (FR); Stephane Guerin, La Garenne Colombes (FR); Jean-Paul Yonnet, Meylan (FR)

(73) Assignee: Peugeot Citroen Automobiles SA, Velizy-Villacoublay (FR)

( * ) Notice: Subject to any disclaimer, the term of this patent is extended or adjusted under 35 U.S.C. 154(b) by 0 days.

(21) Appl. No.: 10/780,947

(22) Filed: Feb. 18, 2004

(65) Prior Publication Data

US 2004/0206320 A1 Oct. 21, 2004

(30) Foreign Application Priority Data

Feb. 18, 2003 (FR) ..... 03 01945

(51) Int. Cl.
*F01L 9/04* (2006.01)

(52) U.S. Cl. ..... 123/90.11; 251/129.01; 251/129.16

(58) Field of Classification Search ..... 123/90.11; 251/129.01, 129.02, 129.15, 129.16, 129.18
See application file for complete search history.

(56) References Cited

U.S. PATENT DOCUMENTS

| | | | | |
|---|---|---|---|---|
| 3,858,135 | A | 12/1974 | Gray | |
| 4,515,343 | A * | 5/1985 | Pischinger et al. | 251/48 |
| 4,533,890 | A | 8/1985 | Patel | |
| 4,715,332 | A | 12/1987 | Kreuter | |
| 6,198,370 | B1 | 3/2001 | Schmitz | |
| 6,216,653 | B1 | 4/2001 | Hara et al. | |
| 6,308,667 | B1 | 10/2001 | Tsai et al. | |
| 6,371,063 | B2 * | 4/2002 | Oyama et al. | 123/90.11 |
| 6,422,533 | B1 * | 7/2002 | Harms | 251/129.1 |
| 6,679,204 | B2 * | 1/2004 | Iida et al. | 123/90.11 |
| 6,755,161 | B2 * | 6/2004 | Grundl et al. | 123/90.11 |

FOREIGN PATENT DOCUMENTS

| | | | |
|---|---|---|---|
| DE | 35 00 530 | A | 7/1986 |
| DE | 100 03 928 | A | 6/2001 |
| EP | 0 422 228 | A | 4/1991 |
| EP | 0 504 806 | A | 9/1992 |
| EP | 0 816 644 | A | 1/1998 |
| EP | 1 010 866 | A | 6/2000 |
| EP | 1 174 595 | A | 1/2002 |
| EP | 1 174 596 | A | 1/2002 |
| EP | 1 264 969 | A | 12/2002 |
| FR | 2 784 497 | A | 4/2000 |
| FR | 2 822 585 | A | 9/2002 |
| JP | 10 047028 | A | 2/1998 |
| JP | 2001 035721 | A | 2/2001 |
| JP | 2002 130510 | A | 5/2002 |

* cited by examiner

*Primary Examiner*—Ching Chang
(74) *Attorney, Agent, or Firm*—Nicolas E. Seckel

(57) ABSTRACT

An electromagnetic valve actuator for internal combustion engines, includes an electromagnet and a mobile magnetic plate intended to come into contact with a part of the electromagnet. At least one stop is located on the electromagnet or on the plate to limit the contact surface between the plate and the electromagnet. The actuator the electromagnet includes a magnet in its magnetic circuit.

11 Claims, 3 Drawing Sheets

FIG_3a
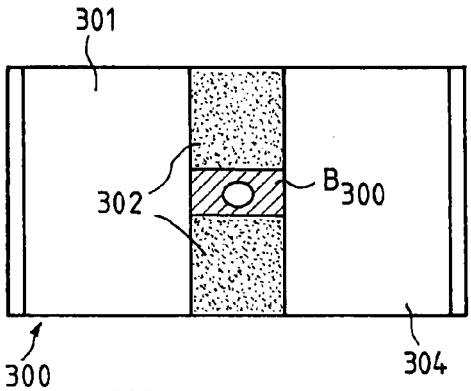
FIG_4a
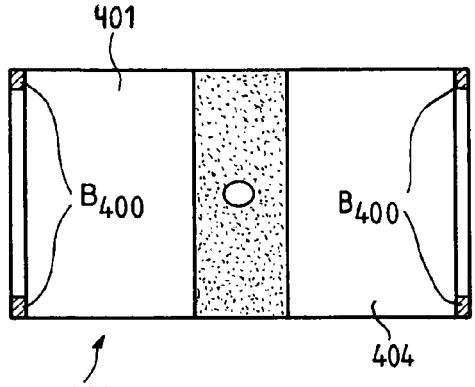
FIG_3b
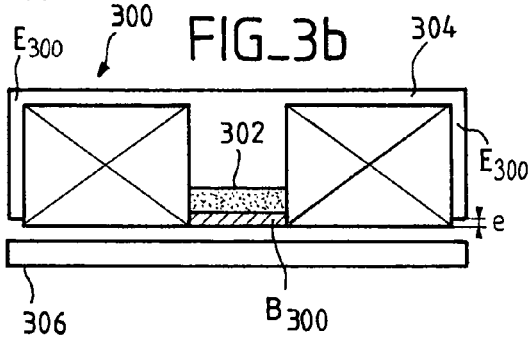
FIG_4b
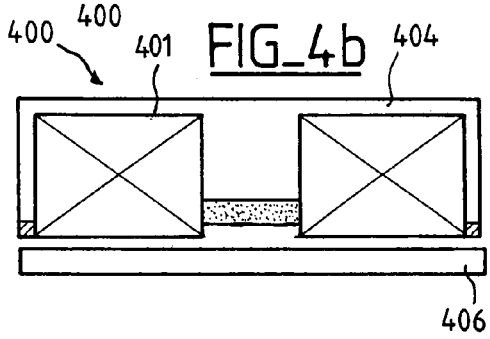
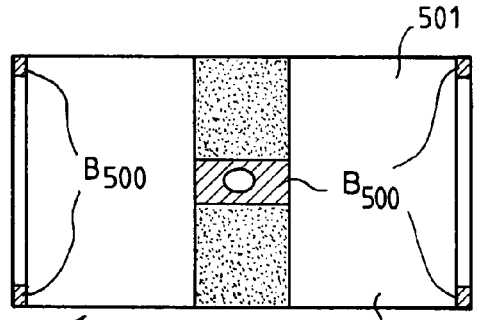
FIG_5a
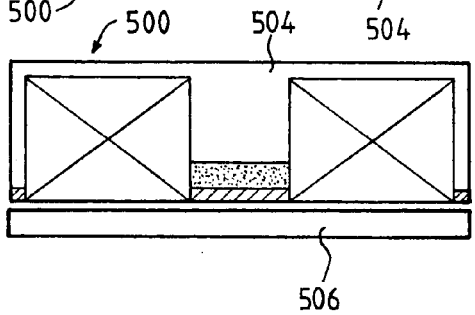
FIG_5b

ELECTROMECHANICAL VALVE ACTUATOR FOR INTERNAL COMBUSTION ENGINES AND INTERNAL COMBUSTION ENGINE EQUIPPED WITH SUCH AN ACTUATOR

This application claims priority of France Application No. 03 01945 filed on Feb. 18, 2003.

FIELD OF THE INVENTION

The present invention pertains to an electromechanical valve actuator for internal combustion engines and to an internal combustion engine equipped with such an actuator.

BACKGROUND

An electromechanical actuator 100 (FIG. 1*a*) for a valve 110 comprises mechanical means, such as springs 102 and 104, and electromagnetic means, such as electromagnets 106 and 108, for controlling the position of the valve 110 by means of electric signals.

The rod of the valve 110 is applied for this purpose against the rod 112 of a magnetic plate 114 located between the two electromagnets 106 and 108.

When current flows in the coil 109 of the electromagnet 108, the latter is activated and attracts the magnetic plate 114, which will come into contact with it.

The simultaneous displacement of the rod 112 enables the spring 102 to bring the valve 110 into the closed position, the head of the valve 110 coming against its seat 111 and preventing the exchange of gas between the interior and the exterior of the cylinder 116.

Analogously (not shown), when current flows in the coil 107 of the electromagnet 106 (the electromagnet 108 being deactivated), it is activated and attracts the plate 114, which comes into contact with it and displaces the rod 112 by means of the spring 104 such that the rod 112 will act on the valve 110 and brings the latter into the open position, the head of the valve being moved away from its seat 111 to permit, for example, the admission or the injection of gas into the cylinder 116.

When the electromechanical actuator 100 is functioning correctly, the valve 110 alternates between fixed open and closed positions, called switched positions, with transient displacements between these two positions. The open or closed state of a valve will hereinafter be called the "switched state."

An actuator 150 (FIG. 1*b*) may also be equipped with magnets 168 (electromagnet 158) and 166 (electromagnet 156) intended to reduce the energy necessary for maintaining the plate 164 in a switched position, i.e., in contact with one of the electromagnets.

SUMMARY OF THE INVENTION

Each magnet, e.g., magnet 166, is located for this purpose between two subelements $\mathbf{156}_a$ and $\mathbf{156}_b$ of the electromagnet 156, so that its magnetic field combines with the field generated by the electromagnet. An electromagnet equipped with a magnet will hereinafter be called a polarized electromagnet.

The present invention results from the observation that the contacts between a magnetic plate and an electromagnet, which are brought about at the time of each switching of the valve, generates a noise, whose intensity increases, in general, when the contact surface between the plate and the electromagnet increases, this contact noise representing an important part of the operating noise of a motor.

The present invention also results from the observation that the use of a polarized electromagnet increases the range of action exerted by the latter on the plate associated with it such that the control of the plate by the electromagnet can be achieved with a limited power supply of the actuator despite the presence of the air gap generated by a stop.

Therefore, the present invention pertains to an electromechanical valve actuator for internal combustion engines, comprising an electromagnet and a mobile magnetic plate intended to come into contact with a part of this electromagnet, at least one stop being located on the electromagnet or on the plate to limit the contact surface between the plate and the electromagnet, characterized in that the electromagnet comprises a magnet in its magnetic circuit.

Consequently, the present invention makes it possible to reduce the contact surface between the plate and the electromagnet and consequently the operating noise of the engine, whereas the use of a magnet makes it possible to compensate the air gap generated by the stop.

In fact, this gain in terms of noise offers advantages, especially advantages linked with the comfort of the passengers, whereas the increase in the power consumption of the electromagnet, which is caused by the presence of an additional air gap generated by the stop, is compensated by the presence of a magnet increasing the range of the electromagnet.

According to one embodiment, the stop is located essentially in the center of the surface of the electromagnet.

In one embodiment, the stop is located on an axis that is collinear with the axis of translation of the plate.

According to one embodiment, a plurality of stops are located on the electromagnet and/or on the plate, and they are arranged symmetrically in relation to the axis of translation of the plate.

In one embodiment, the electromagnet is formed by an E-shaped support with three branches, and the stop is located at the end of one of the branches of the support.

According to one embodiment, when the electromagnet and the plate are in contact with each other, the stop maintains an air gap between each end branch of the support of the electromagnet and the plate.

In one embodiment, the magnet is located on the surface of one of the branches of the support, opposite the magnetic plate.

According to one embodiment, two magnets are located on the surface of the support, and the stop is fixed between these two magnets.

In one embodiment, the stop is made of a magnetic material.

According to one embodiment, the stop is made of an elastic material, e.g., an elastomer type material.

The present invention also pertains to an internal combustion engine equipped with an electromechanical valve actuator comprising an electromagnet and a mobile magnetic plate coming into contact with the electromagnet. According to the present invention, the actuator of such an engine is according to one of the actuator embodiments described below.

BRIEF DESCRIPTION OF THE DRAWINGS

Other characteristics and advantages of the present invention will become apparent from the following description given as a nonlimiting example with reference to the drawings attached, in which:

FIGS. 3*a*, 3*b*, 4*a*, 4*b*, 5*a* and 5*b* show different variants of the present invention.

DETAILED DESCRIPTION

The description of the present invention as will be described below is related to polarized electromagnets. Such polarized electromagnets do, in fact, offer the advantage of exerting an action that is less sensitive to the change in the air gap between the magnetic plate and the electromagnet than are nonpolarized electromagnets, as is shown in FIG. 2.

Figure 1A:
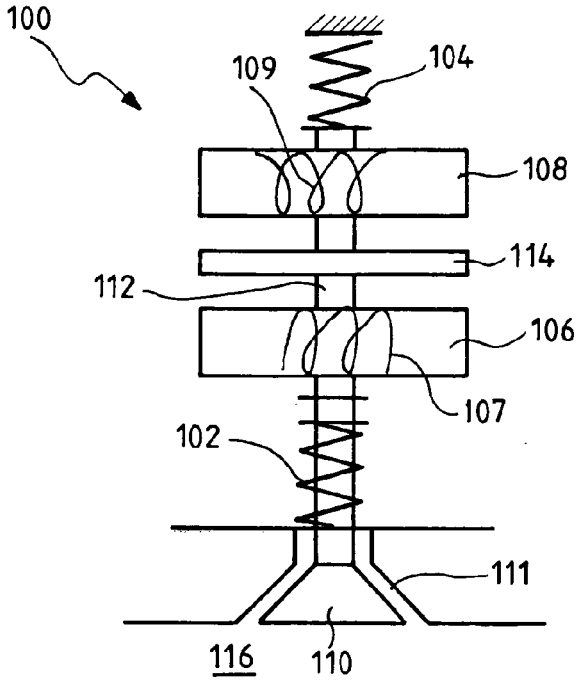
FIG 1a PRIOR ART
FIGS. 1*a* and 1*b*, already described, show prior-art electromechanical actuators.
Figure 1B:
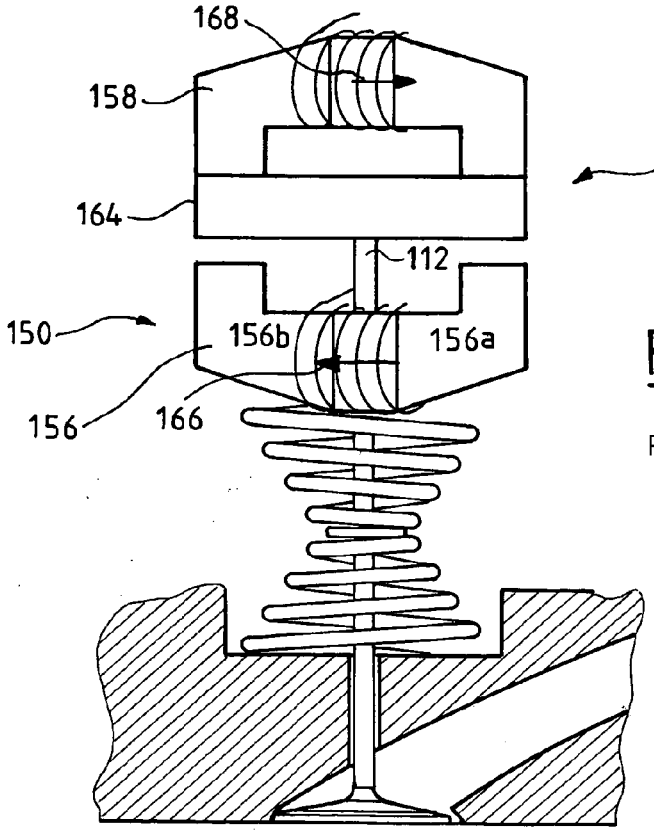
FIG 1b PRIOR ART
Figure 2:
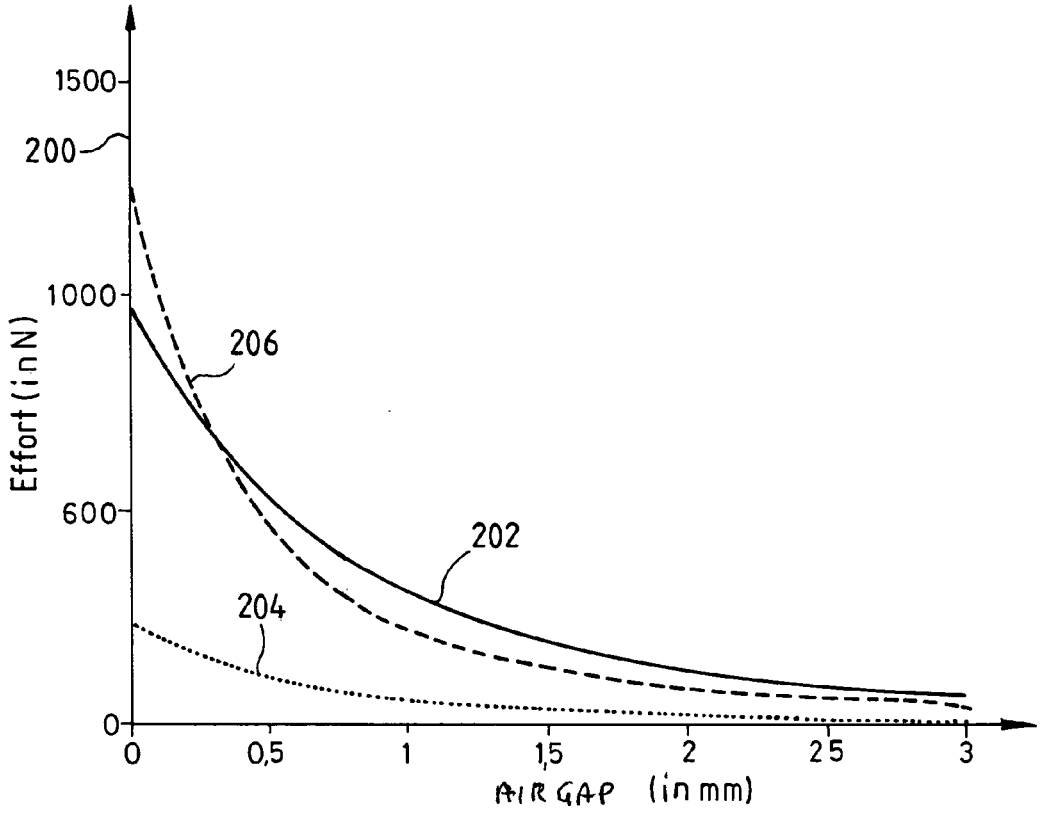
FIG. 2 is a diagram showing different actions exerted by a polarized electromagnet and by a nonpolarized electromagnet on a magnetic plate.

This FIG. 2 is a diagram showing the force of attraction (ordinate 200, in N/m) exerted by an active polarized electromagnet (curve 202), i.e., an electromagnet generating a magnetic field by means of its coil, or an inactive electromagnet (curve 204), and by a nonpolarized electromagnet (curve 206) on a magnetic plate as a function of the air gap e separating the electromagnet in question from the plate.

It is seen that the range of action exerted by the polarized electromagnet (curve 202) is greater than the range of the nonpolarized electromagnet. More precisely, the action exerted by the polarized electromagnet on the magnetic plate with an air gap of 3 mm is equivalent to the action exerted by the nonpolarized electromagnet with an air gap of 1.7 mm.

FIGS. 3*a* and 3*b* show a first embodiment of an electromagnetic actuator 300 according to the present invention as a top view (FIG. 3*a*) and as a side view (FIG. 3*b*).

A single stop $B_{300}$, intended to maintain an air gap between the support 304 of the electromagnet 301 and the plate 306, is arranged in this first embodiment on the support 304 between two magnets 302 arranged on the same surface.

As is shown in FIG. 3*b*, the end branches $E_{300}$ of the support 304 are limited in such a way as to limit an air gap e between the surface of the plate 306 and the surface of these branches $E_{300}$ of the support.

Thus, when the plate 306 comes into contact with the stop $B_{300}$, no contact is made with these branches $B_{300}$, thus limiting the contact surface between the plate 306 and the support 304.

It should be pointed out that in order to protect the magnets 302 from shocks, an air gap must also be maintained between these magnets and the plate 306.

The stop acting as a contact point is made of a magnetic material in this embodiment so as not to generate an additional air gap.

However, the stop is made of an elastomeric material in one variant in order to absorb the energy during contact between the plate and the stop, thus limiting the noise being generated.

FIG. 4*a* (top view) and FIG. 4*b* (front view) show a second variant of the present invention, in which four stops $B_{400}$ are located on the surface of the support 404 of the electromagnet 401 of an actuator 400.

The use of a high number of stops makes it possible to ensure the parallelism between the surface of the plate 406 and the surface of the support 404 when these plates come into contact with each other.

These stops are therefore distributed symmetrically in relation to the central axis C of the surface of the support 404, which [said axis] is collinear with the axis of translation of the magnetic plate 406 being controlled by this electromagnet.

In a variant shown in FIGS. 5*a* and 5*b*, five stops $B_{500}$ are used in the actuator 500 to further improve the contact between the plate 506 and the support 504 of the electromagnet 501 by combining a central stop, as shown in FIGS. 3*a* and 3*b*, with four peripheral stops, as shown in FIGS. 4*a* and 4*b*.

It should be pointed out that the actuators shown in FIGS. 3*a*, 3*b*, 4*a*, 4*b*, 5*a* and 5*b* are polarized by means of a magnet located on the E-shaped support of an electromagnet, opposite the magnetic plate, which facilitates the fixation and/or the replacement of these magnets.

What is claimed:

1. An electromechanical valve actuator for an internal combustion engine, comprising an electromagnet and a mobile magnetic plate coupled to a valve of the engine, said electromagnet comprising a magnet in a magnetic circuit, at least one stop being located between said magnet of said electromagnet and said mobile magnetic plate, wherein the at least one stop includes a plurality of stops and each of the plurality of stops is located on one of the electromagnet and the plate, the stops being arranged symmetrically in relation to an axis of translation of the plate, and the electromagnet comprises an E-shaped magnetic circuit, and at least one of the stops is located at an end of each of three branches that form the E-shaped magnetic circuit, so that an air gap is maintained between each end branch of the magnetic circuit of the electromagnet and the plate.

2. Actuator in accordance with claim 1, wherein at least one of the stops is located essentially in the center of the contact surface between the electromagnet and the plate.

3. Actuator in accordance with claim 1, wherein the at least one stop at an end of the center branch of the magnetic circuit is located on an axis that is collinear with an axis of translation of the plate.

4. Actuator in accordance with claim 1, wherein the branches that form the E-shaped magnetic circuit are essentially parallel.

5. Actuator in accordance with claim 4, wherein the magnet is located on the surface of the one of the three essentially parallel branches of the E-shaped circuit, opposite the magnetic plate.

6. Actuator in accordance with claim 4, further comprising a second magnet, wherein the first and second magnets are located on a surface of the E-shaped circuit, and the stop is located between the first and second magnets.

7. An internal combustion engine equipped with a electromechanical valve actuator for internal combustion engines, comprising a electromagnet and a mobile magnetic plate coming into contact with the electromagnet, wherein the actuator is according to claim 1.

8. Actuator in accordance with claim 1, wherein at least one of the stops comprises a material adapted to absorb energy.

9. The electromechanical valve actuator in accordance with claim 1, wherein a contact surface area of the mobile magnetic plate is smaller than a total surface area of the plate.

10. An electromechanical valve actuator for an internal combustion engines according to claim 9, wherein at least one of the stops is made of a magnetic material.

11. An electromechanical valve actuator for an internal combustion engines according to claim 9, wherein at least one of the stops is made of an elastomeric material.

* * * * *